US010167769B2

(12) United States Patent
Auerbach et al.

(10) Patent No.: US 10,167,769 B2
(45) Date of Patent: Jan. 1, 2019

(54) TEMPERATURE CONTROL SYSTEM FOR HYBRID POWERTRAIN AND METHOD OF OPERATING A TEMPERATURE CONTROL SYSTEM

(71) Applicant: AUDI AG, Ingolstadt (DE)

(72) Inventors: Michael Auerbach, Ingolstadt (DE); Johannes Brunner, Neuburg an der Donau (DE); Ralf Kleisch, Asperg (DE); Andreas Oberting, Stuttgart (DE)

(73) Assignee: Audi AG, Ingolstadt (DE)

( * ) Notice: Subject to any disclaimer, the term of this patent is extended or adjusted under 35 U.S.C. 154(b) by 0 days.

(21) Appl. No.: 15/448,007

(22) Filed: Mar. 2, 2017

(65) Prior Publication Data

US 2017/0260894 A1 Sep. 14, 2017

(30) Foreign Application Priority Data

Mar. 12, 2016 (DE) ..... 10 2016 003 076

(51) Int. Cl.
*F01P 3/20* (2006.01)
*F01P 7/16* (2006.01)
*F01P 9/06* (2006.01)

(52) U.S. Cl.
CPC ..... *F01P 3/20* (2013.01); *F01P 7/165* (2013.01); *F01P 9/06* (2013.01); *F01P 2050/24* (2013.01)

(58) Field of Classification Search
CPC .... F01P 2050/24; F01P 7/165; F01P 2031/30; F01P 7/048
See application file for complete search history.

(56) References Cited

U.S. PATENT DOCUMENTS 7,621,262 B2 * 11/2009 Zubeck ..... B60K 6/442 123/543
9,096,207 B2 * 8/2015 Madurai Kumar ..... B60K 6/48
9,181,866 B2 * 11/2015 Jensen ..... F02B 63/04
2007/0137909 A1 6/2007 Zillmer
2010/0170455 A1 7/2010 Feldhaus
(Continued)

FOREIGN PATENT DOCUMENTS

DE 102005047653 A1 4/2007
DE 102007004979 A1 8/2008
(Continued)

*Primary Examiner* — Long T Tran
(74) *Attorney, Agent, or Firm* — Henry M. Feiereisen LLC

(57) ABSTRACT

A temperature control system for a hybrid powertrain includes a first coolant circuit for temperature control of a first drive device of the hybrid powertrain and a second coolant circuit for temperature control of a second drive device. The second coolant circuit has a first subcircuit, connected for heat transfer to the second drive device, and a second subcircuit, connected at least temporarily for heat transfer to an energy store of the second drive device. The first and second subcircuits are operable separately from one another. A coolant duct is connected to the first drive device for heat transfer and is fluidly connected in a first operating mode with the first coolant circuit in the absence of a fluid communication with the second coolant circuit, and fluidly connected in a second operating mode with the second coolant circuit in the absence of a fluid communication with the first coolant circuit.

18 Claims, 1 Drawing Sheet

(56) References Cited

U.S. PATENT DOCUMENTS

| | | | | |
|---|---|---|---|---|
| 2012/0048504 | A1 | 3/2012 | Park | |
| 2012/0173063 | A1* | 7/2012 | Madurai Kumar | B60K 6/48 701/22 |
| 2013/0111932 | A1* | 5/2013 | Mishima | F25B 29/00 62/79 |
| 2014/0373533 | A1* | 12/2014 | Jensen | F02B 63/04 60/612 |
| 2015/0308719 | A1* | 10/2015 | Gebbie | B60H 1/00921 62/71 |
| 2016/0032815 | A1* | 2/2016 | Nguyen | B60K 6/22 180/65.275 |
| 2016/0121691 | A1* | 5/2016 | Liu | B60H 1/00921 62/115 |
| 2016/0318499 | A1* | 11/2016 | Yamanaka | B60W 10/06 |
| 2016/0332505 | A1* | 11/2016 | Yamanaka | B60L 11/18 |

FOREIGN PATENT DOCUMENTS

| | | | |
|---|---|---|---|
| DE | 102007005391 | A1 | 8/2008 |
| DE | 102010043576 | A1 | 3/2012 |
| GB | 2462904 | A | 3/2010 |
| WO | WO 2010/083198 | A1 | 7/2010 |

* cited by examiner

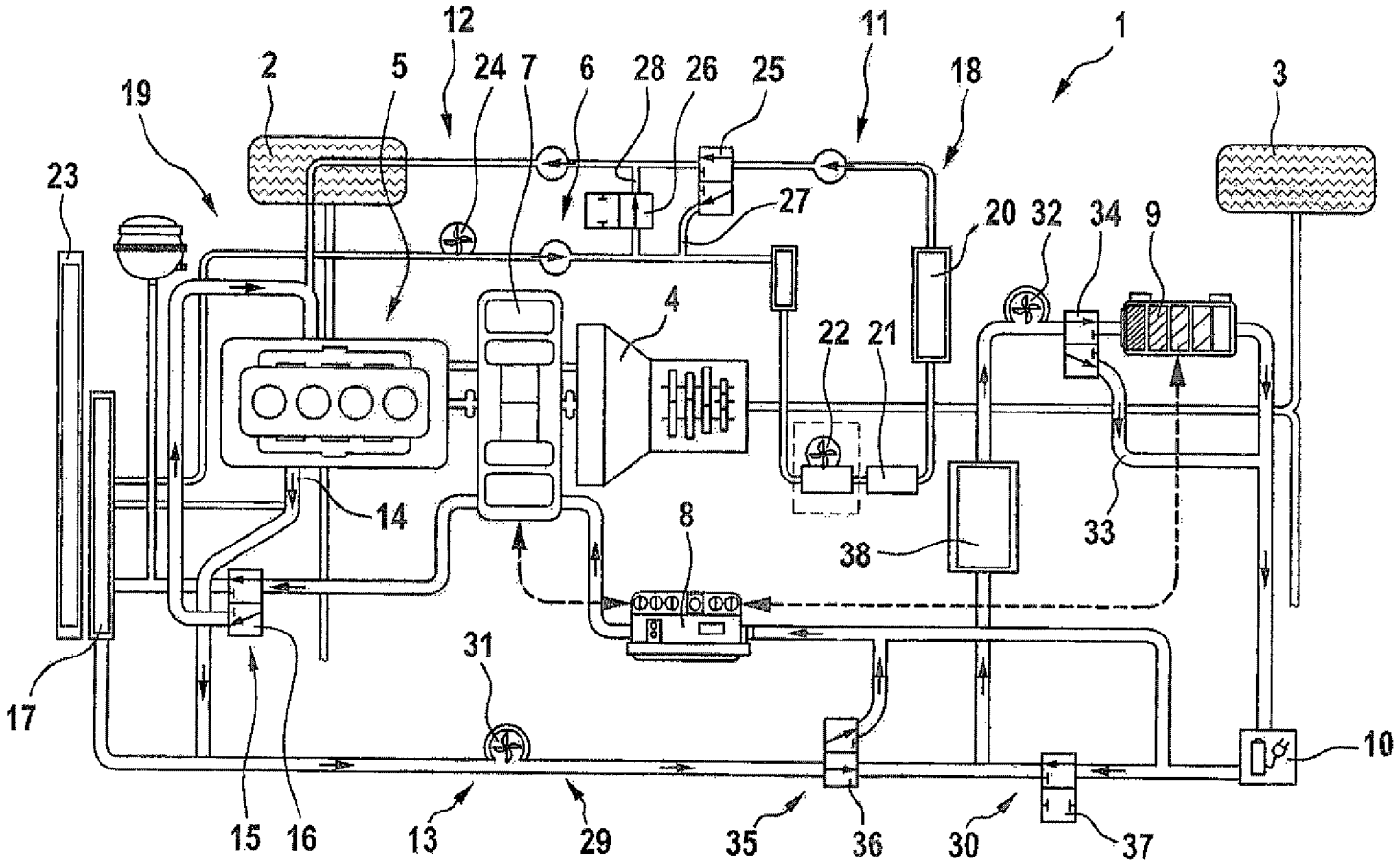
1
2
3
4
5
6
7
8
9
10
11
12
13
14
15
16
17
18
19
20
21
22
23
24
25
26
27
28
29
30
31
32
33
34
35
36
37
38

TEMPERATURE CONTROL SYSTEM FOR HYBRID POWERTRAIN AND METHOD OF OPERATING A TEMPERATURE CONTROL SYSTEM

CROSS-REFERENCES TO RELATED APPLICATIONS

This application claims the priority of German Patent Application, Serial No. 10 2016 008 076.3, filed Mar. 12, 2016, pursuant to 35 U.S.C. 119(a)-(d), the disclosure of which is incorporated herein by reference in its entirety as if fully set forth herein.

BACKGROUND OF THE INVENTION

The present invention relates to a temperature control system for a hybrid powertrain and method of operating a temperature control system The following discussion of related art is provided to assist the reader in understanding the advantages of the invention, and is not to be construed as an admission that this related art is prior art to this invention.

A hybrid powertrain is used for example to power a motor vehicle by using different types of drive devices to produce the necessary torque. One drive device may be an internal combustion engine and another drive device may be an electric machine. During operation, the first and second drive devices generate heat. At the same time, in order to run reliably and efficiently the first and second drive devices should operate at a specific operating temperature or temperature range. The use of cooling devices and heating elements has been proposed to provide a temperature control. This is accompanied by high energy consumption.

It would therefore be desirable and advantageous to obviate other prior art shortcomings.

SUMMARY OF THE INVENTION

According to one aspect of the present invention, a temperature control system for a hybrid powertrain includes a first coolant circuit for controlling a temperature of a first drive device of the hybrid powertrain, a second coolant circuit for controlling a temperature of a second drive device of the hybrid powertrain, the second coolant circuit having a first subcircuit, connected in a heat-transmitting manner to a drive unit of the second drive device, and a second subcircuit, connected at least temporarily in a heat-transmitting manner to an energy store for the drive unit of the second drive device, the first and second subcircuits being operable separately from one another, and a coolant duct connected to the first drive device in a heat-transmitting manner, the coolant duct being fluidly connected in a first operating mode with the first coolant circuit in the absence of a fluid communication with the second coolant circuit, and fluidly connected in a second operating mode with the second coolant circuit in the absence of a fluid communication with the first coolant circuit.

The term "in a heat-transmitting manner" in relation to the coolant duct is to be understood as relating to a coolant duct that can be routed directly through the first drive device, e.g. in the form of at least one coolant channel. When the first drive device is an internal combustion engine, the coolant channel may be formed for example in a casing of the internal combustion engine, in particular in a cylinder crankcase of the internal combustion engine.

It is also conceivable to route the coolant duct via a heat exchanger which is in heat-transmitting relation with the first drive device. The heat transfer connection between the heat exchanger and the first drive device may be directly, i.e. the heat exchanger may be placed or mounted directly on the first drive device or be part thereof. The heat transfer connection may also be established via a further medium, e.g. a coolant, a refrigerant, or the like, that passes through the heat exchanger and is fed subsequently to the first drive device.

The coolant duct can be selectively associated to the first coolant circuit or the second coolant circuit. In the first operating mode, the coolant duct forms part of the first coolant circuit and in the second operating mode, the coolant duct forms part of the second coolant circuit. Thus, the coolant duct is in fluid communication with the first coolant circuit in the first operating mode and in fluid communication with the second coolant circuit in the second operating mode, while being disconnected from the respectively other coolant circuit, i.e. in the first operating mode from the second coolant circuit and in the second operating mode from the first coolant circuit.

A temperature control system according to the present invention is capable of being used in many ways, in particular during a warm-up phase, for example. For example, heat produced by the first drive device can be used to heat the second drive, in particular the energy store, or heat produced by the second drive device can be used to heat the first drive device and/or the energy store. For example, when the first drive device heats up, at least one component of the first drive device, e.g. a bearing, especially a cylinder sleeve and/or a mounting point of the bearing, is heated.

The operating mode of the temperature control system or of the hybrid powertrain can be executed as a function of a temperature, e.g. an outside temperature, i.e. ambient temperature, or a temperature of the temperature control system or hybrid powertrain, or advantageously also a temperature of the energy store. When the temperature drops below a temperature threshold, there is no energy or only insufficient energy that can be drawn from the energy store in order to power the second drive device. Thus, it is necessary to first warm up the energy store. For this purpose, heat generated by the first drive device or internal combustion engine is used.

When the temperature is thus below the temperature threshold, the first drive device is put into operation, while the second drive device is disabled. In addition, the coolant duct is now associated to the second coolant circuit, so that coolant in the second coolant circuit is heated by heat generated by the first drive device to thereby also warm up the second drive device and in particular the energy store. Conversely, when the temperature exceeds the temperature threshold, the second drive device can be powered by electric energy drawn from the energy store.

When the temperature of the first drive device is smaller than its operating temperature, provision may be made to use heat, produced by the second drive device, for warming up the first drive device. This is especially the case, when energy is drawn from the energy store for powering the second drive device, i.e. when the temperature exceeds the temperature threshold. The coolant duct is also associated in this scenario to the second coolant circuit, i.e. the second operating mode is executed. In the second operating mode, the coolant duct is decoupled from a cooling device of the temperature control system, especially a primary cooling device of the temperature control system. Coolant streaming through the coolant duct is thus prevented from flowing through the cooling device. It is currently preferred that the operating temperature of the first drive device exceeds the temperature threshold.

When the temperature of the energy store exceeds the temperature threshold, while the temperature of the first drive device is smaller than its operating temperature, the second drive device is advantageously powered, whereas the first drive device is disabled.

The first drive device is thus warmed up by heat generated by the second drive device. Of course, the first drive device may also be powered in addition. In this case, the first drive device is warmed up by heat produced by the first drive device itself. Heat produced by the second drive device may, however, be supplied for additional heating.

When the temperature of the first drive device reaches operating temperature or an operating temperature range, further heating of the first drive device and the second drive device and its energy store becomes unnecessary. Therefore, the first operating mode is initiated in which the coolant duct is fluidly connected with the first coolant circuit while being fluidly disconnected from the second coolant circuit. During continued operation of the hybrid powertrain, it can be additionally freely determined whether only the first drive device, or only the second drive device, or both the first and second drive devices is/are operated to provide the torque for powering the motor vehicle.

According to another advantageous feature of the present invention, a first valve device can be operably connected to the second coolant circuit and configured to connect the second coolant circuit in a first switching mode with a coolant cooler and to connect the second coolant circuit in a second switching mode to the coolant duct. The first valve device can include one or more valves and is provided to couple or decouple the coolant duct and a coolant cooler to and from the second coolant circuit. Advantageously, the coolant duct and the coolant cooler can be fluidly connected to or fluidly disconnected from the second coolant circuit independently from one another. The valve may involve, for example, a switching valve, mixing valve, slide valve, or the like.

The coolant cooler can be fluidly connected to the second coolant circuit in the first switching mode of the first valve device. Provision may hereby be made for the coolant duct to be disconnected from the second coolant circuit. Conversely, in the second switching mode, the first valve device fluidly connects the coolant duct to the second cooling circuit. Provision may also be made in this case for the coolant cooler to be disconnected from the second coolant circuit.

According to another advantageous feature of the present invention, the first coolant circuit can include an air conditioning circuit and a cooling circuit configured for operation independently from the air conditioning circuit, the coolant duct being part of the cooling circuit at least temporarily. The first coolant circuit is thus composed of the air conditioning circuit and the cooling circuit. The air conditioning circuit is provided to control the temperature inside of the motor vehicle, such as a passenger compartment. The cooling circuit can include, at least temporarily, the coolant duct in the first operating mode and is provided to dissipate heat from the first drive device or to feed heat to the first drive device. As the air conditioning circuit and the cooling circuit should be operated independently from one another, they have each a separate coolant pump.

According to another advantageous feature of the present invention, a heat source, e.g. electric heat source, can be disposed in the first coolant circuit or in the air conditioning circuit. When using heat, generated by the first drive device, for heating the second drive device or the energy store, this heat is no longer available to maintain the temperature inside of the motor vehicle. Thus, heat has to be supplied to the first coolant circuit or air conditioning circuit in another way. This can now be realized by the provision of the heat source which may be part of an engine-independent heating system of the motor vehicle.

As described above, the first coolant subcircuit of the second coolant circuit is connected in a heat-transmitting manner with the drive unit of the second drive device. Coolant in the first coolant subcircuit can be supplied directly to the drive unit or to a heat exchanger connected to the drive unit in a heat-transmitting manner. The same applies for the second coolant subcircuit and the energy store. The drive unit of the second drive device is represented, for example, by an electric machine or electric machine with power electronics. The first coolant subcircuit may thus be connected with the electric machine or, as an alternative, with both the electric machine and its power electronics in a heat-transmitting manner.

The second coolant subcircuit can be connected to the energy store in a heat-transmitting manner at least temporarily but also permanently. When connected temporarily, a bypass line may be provided to bypass the energy store. The energy store can include, for example, battery cells or both battery cells and associated power electronics, such as a charger. Thus, the second coolant circuit is connected to the battery cells or both battery cells and associated power electronics in a heat-transmitting manner.

The bypass line is provided to allow coolant, circulating in the second coolant subcircuit, to circumvent the energy store. Provision can thus be made for coolant to bypass the battery cells of the energy store, whereas the power electronics of the energy store can be permanently connected with the second coolant subcircuit in a heat-transmitting manner.

According to another advantageous feature of the present invention, a heat exchanger can be disposed in the second coolant circuit or second coolant subcircuit and connected to a refrigerant circuit. The heat exchanger may also be designated as "chiller". The refrigerant circuit is provided to cool coolant flowing in the second coolant circuit or second coolant subcircuit, regardless of the ambient temperature. Thus, even at high ambient temperatures, the refrigerant circuit enables to maintain the coolant, fed to the energy store, at a sufficiently low temperature. Coolant circulating in the second coolant circuit is coupled in a heat-transmitting manner via the heat exchanger with a coolant in the refrigerant circuit. For example, provision may be made to relieve coolant in or at least in a region of the heat exchanger, so that coolant of the second coolant circuit can be cooled down.

The first and second coolant subcircuits can be operated separately from one another. Thus, each of the first and second coolant subcircuits includes a coolant pump. Coolant in the first coolant subcircuit can thus circulate independently from the second coolant subcircuit, and vice versa. As a result, heat generated by the second drive device can be used to heat the first drive device, without further warming up the energy store. The energy store may actually be decoupled from the first drive device by operating the first and second coolant subcircuits independently from one another. It is, of course, also conceivable to simply shutdown one of the first and second coolant subcircuits.

According to another advantageous feature of the present invention, a second valve device can be provided to fluidly connect the first and second subcircuits with one another in a first switching mode and to fluidly disconnect the first and second subcircuits from one another in a second switching mode. The second valve device may, like the first valve device, include one or more valves, involving, e.g., a switching valve, mixing valve, slide valve, or the like. The fluid communication may be realized, for example, with an adjustable mass flow rate. There is thus no need to permanently maintain the second valve device in a fully open state. Rather, the second valve device may only be partly open in the first switching state or even temporarily fully closed, e.g. operated in a clocked manner.

According to another aspect of the present invention, a hybrid powertrain includes a first drive device, a second drive device, and a temperature control system which includes a first coolant circuit for controlling a temperature of the first drive device, a second coolant circuit for controlling a temperature of the second drive device of the hybrid powertrain, the second coolant circuit having a first subcircuit, connected in a heat-transmitting manner to a drive unit of the second drive device, and a second subcircuit, connected at least temporarily in a heat-transmitting manner to an energy store for the drive unit of the second drive device, the first and second subcircuits being operable separately from one another, and a coolant duct connected to the first drive device in a heat-transmitting manner, the coolant duct being fluidly connected in a first operating mode with the first coolant circuit in the absence of a fluid communication with the second coolant circuit, and fluidly connected in a second operating mode with the second coolant circuit in the absence of a fluid communication with the first coolant circuit.

According to another aspect of the present invention, a method of operating a temperature control system includes controlling a temperature of a first drive device of the hybrid powertrain via a first coolant circuit, controlling a temperature of a second drive device of the hybrid powertrain via a second coolant circuit by connecting a first subcircuit of the second coolant circuit in a heat-transmitting manner to a drive unit of the second drive device, and by connecting a second subcircuit of the second coolant circuit, at least temporarily, in a heat-transmitting manner to an energy store for the drive unit of the second drive device, with the first and second subcircuits being operable separately from one another, and connecting a coolant duct to the first drive device in a heat-transmitting manner such that the coolant duct is fluidly connected in a first operating mode with the first coolant circuit in the absence of a fluid communication with the second coolant circuit, and fluidly connected in a second operating mode with the second coolant circuit in the absence of a fluid communication with the first coolant circuit.

BRIEF DESCRIPTION OF THE DRAWING

Other features and advantages of the present invention will be more readily apparent upon reading the following description of currently preferred exemplified embodiments of the invention with reference to the accompanying drawing, in which the sole FIG. 1 is a schematic illustration of a hybrid powertrain with a temperature control system in accordance with the present invention.

DETAILED DESCRIPTION OF PREFERRED EMBODIMENTS

The depicted embodiment is to be understood as illustrative of the invention and not as limiting in any way. It should also be understood that the FIGURE may not necessarily be to scale. In certain instances, details which are not necessary for an understanding of the present invention or which render other details difficult to perceive may have been omitted.

Turning now to FIG. 1, there is shown a schematic illustration of a hybrid powertrain in accordance with the present invention, generally designated by reference numeral 1, for powering a motor vehicle which is represented in FIG. 1 solely by the depiction of a wheel 2 of a front axle and a wheel 3 of the rear axle. At least the wheel 3 can be powered by the hybrid powertrain 1. The hybrid powertrain 1 includes a transmission 4, e.g. a multi-speed transmission, via which the wheel 3 is operably connected to a first drive device 5 and a second drive device 6. The first drive device 5 is an internal combustion engine, while the second drive device 6 includes an electric machine 7, a power electronics 8 which is operably connected to the electric machine 7, and an energy store 9 which includes a power electronics 10.

The hybrid powertrain 1 further includes a temperature control system, generally designated by reference numeral 11. The temperature control system 11 includes a first coolant circuit 12 and a second coolant circuit 13. The first coolant circuit 12 is provided to control a temperature of the first drive device 5, and the second coolant circuit 13 is provided to control a temperature of the second drive device 6. The temperature control system 11 further includes a coolant duct 14 which can be fluidly connected with the first coolant circuit 12 in a first operating mode and with the second coolant circuit 13 in a second operating mode. In either one of the first and second operating modes, the coolant duct 14 is disconnected from the respectively other one of the first and second coolant circuits 12, 13. The coolant duct 14 extends, for example, through the first drive device 5, i.e. internal combustion engine, e.g. through a casing or through a cylinder crankcase of the internal combustion engine.

One of the coolant circuits 12, 13, for example the first coolant circuit 12, may be embodied as a high-temperature coolant circuit, whereas the other one of the coolant circuits 12, 13, in this case the second coolant circuit 13, may be embodied as a low-temperature coolant circuit. Thus, during normal operation of the temperature control system 1, involving a virtually stationary operation at substantially constant coolant temperature, the temperature of coolant in the first coolant circuit 12 is higher than the temperature of coolant in the second coolant circuit 13. Advantageously, both coolant circuits 12, 13 contain a same coolant.

A first valve device 15 is provided to set the first operating mode or the second operating mode. For sake of simplicity, only one valve 16 of the valve device 15 is shown. The valve device 15 controls whether a coolant cooler 17, e.g. a low-temperature coolant cooler, or the coolant duct 14 is connected to the second coolant circuit 13, i.e. in a first switching state, the valve device 15 connects the coolant cooler 17 with the second coolant circuit 13, and in a second switching state, the valve device 15 connects the coolant duct 14 with the second coolant circuit 13.

The first coolant circuit 12 includes an air conditioning circuit 18 and a cooling circuit 19. The air conditioning circuit 18 is provided to control the temperature inside the motor vehicle, i.e. passenger cell of the motor vehicle, and includes an air-conditioning heat exchanger 20, a heat source 21 and a coolant pump 22. The coolant duct 14 forms at least temporarily part of the cooling circuit 19 in the first operating mode. In the second operating mode, in which the coolant duct 14 is fluidly connected to the second coolant circuit 13, the coolant circuit 19 is disconnected. The cooling circuit 19 includes a cooler 23, in particular a primary cooler, which can be designated as high-temperature cooler, and a coolant pump 24.

The first coolant circuit 12 includes at least two valves 25 and 26 by which the air conditioning circuit 18 and the cooling circuit 19 can be fluidly disconnected from one another. The valve 25 can be embodied as a 3/2 directional control valve and the valve 26 can be embodied as a 2/2 directional control valve. In a first switching position of the valve 25, the air-conditioning heat exchanger 20 is fluidly connected to the first drive device 5 for example, in particular fluidly connected via the first drive device 5 to the cooler 23. The coolant pump 24 conveys coolant of the first coolant circuit 12 from the cooler 23 in the direction of the air-conditioning heat exchanger 20. Coolant flows hereby through the coolant pump 22 and/or the heat source 21 for example.

In a second switching position of the valve 25, the air-conditioning heat exchanger 20 is advantageously fluidly disconnected from the first drive device 5 and coolant exiting the air-conditioning heat exchanger 20 is conveyed by the coolant pump 22 back to the air-conditioning heat exchanger 20 via a bypass line 27 and advantageously via the heat source 21. As a result, the air conditioning circuit 18 can be operated in the second switching position of the valve 24 independently from the cooling circuit 19.

When the valve 25 assumes the first switching position, the valve 26 assumes a first switching position, in which a coolant flow through a bypass line 28 is blocked. The valve 26 assumes a second switching position, when the valve 25 also assumes its second switching position, to clear the bypass line 28. Coolant can now be conveyed by the coolant pump 24 via the bypass line 28 to the coolant duct 14 and from there to the cooler 23. Coolant can then flow from the cooler 23 to the coolant pump 24. The cooling circuit 19 can also be operated independently, in particular independently from the air conditioning circuit 18. This, however, is possible only in the first operating mode in which the coolant duct 14 is coupled to the first coolant circuit 12.

The second coolant circuit 13 includes a coolant subcircuit 29 and a second coolant subcircuit 30. The first coolant subcircuit 29 is connected in a heat-transmitting manner with the second drive device 6, i.e. the electric machine and/or the power electronics 8 thereof. The valve device 15 controls hereby whether the coolant cooler 17 or the coolant duct 14 is coupled to the first coolant subcircuit 29. In the first operating mode, it is the coolant cooler 17 that is fluidly connected to the first coolant subcircuit 29, whereas in the second operating mode, it is the coolant duct 14 that is fluidly connected to the first coolant subcircuit 29. A coolant pump 31 is disposed in the first coolant subcircuit 29 in addition to the electric machine 7 and/or the power electronics 8.

The second coolant subcircuit 30 is connected in a heat-transmitting manner, at least temporarily, with the energy store 9, and may also be connected in a heat-transmitting manner to the power electronics 10, e.g. a charger of the energy store 9. A coolant pump 32 is disposed in the second coolant subcircuit 30. Coolant in the second coolant subcircuit 30 can bypass the energy store 9 via a bypass line 33. A valve 34, e.g. a 3/2 directional control valve, selectively closes or clears a coolant flow through the bypass line 33. In a first switching position of the valve 34, coolant of the second coolant subcircuit 30 flows through the energy store 9, while the bypass line 33 is closed. In a second switching position, coolant flows through the bypass line 33, but not through the energy store 9.

A second valve device 35 is operably connected to the second coolant circuit 13 and includes valves 36 and 37 to selectively connect the coolant subcircuits 29, 30 with one another or fluidly disconnect the coolant subcircuits 29, 30 from one another. For example, in a first switching position of the valve 36, coolant of the first coolant subcircuit 29 is conveyed by the coolant pump 31 directly to the power electronics 8 and/or the electric machine 7. In a second switching position, coolant flows from the coolant pump 31 in the direction of the coolant pump 32, e.g. via a heat exchanger 38 which is connected to a not shown refrigerant circuit.

In a first switching position of the valve 37, a flow communication is established between a downstream side of the coolant pump 32 and the heat exchanger 38, in particular via the energy store 9 (in the first switching position of the valve 34) and/or the power electronics 10. In the second switching position of the valve 37, the flow communication is blocked, so that instead a fluid communication is established between the downstream side of the coolant pump 32 and the power electronics 8 and/or the electric machine 7, also advantageously via the energy store 9 and/or the power electronics 10.

With the assistance of the valve devices 15, 35 and the valves 25, 26, 34, the first drive device 5 and the second drive device 6 can be appropriately cooled and an appropriate heat transport between the first and second drive devices 5, 6 is rendered possible. For example, heat, generated by one of the drive devices 5, 6 can be used to warm up the other one of the drive devices 5, 6 and/or energy store 9.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed is:

1. A temperature control system for a hybrid powertrain, comprising:

a first coolant circuit for controlling a temperature of a first drive device of the hybrid powertrain;

a second coolant circuit for controlling a temperature of a second drive device of the hybrid powertrain, said second coolant circuit having a first subcircuit, connected in a heat-transmitting manner to a drive unit of the second drive device, and a second subcircuit, connected at least temporarily in a heat-transmitting manner to an enemy store for the drive unit of the second drive device, said first and second subcircuits being operable separately from one another; and a coolant duct connected to the first drive device in a heat-transmitting manner, said coolant duct being fluidly connected in a first operating mode with the first coolant circuit in the absence of a fluid communication with the second coolant circuit, and fluidly connected in a second operating mode with the second coolant circuit in the absence of a fluid communication with the first coolant circuit, wherein the first coolant circuit includes an air conditioning circuit and a cooling circuit configured for operation independently from the air conditioning circuit, said coolant duct being part of the cooling circuit at least temporarily.

2. The temperature control system of claim 1, further comprising a first valve device operably connected to the second coolant circuit and configured to connect the second coolant circuit in a first switching mode with a coolant cooler and to connect the second coolant circuit in a second switching mode to the coolant duct.

3. The temperature control system of claim 1, further comprising a heat source disposed in the first coolant circuit.

4. The temperature control system of claim 3, wherein the heat source is an electric heat source.

5. The temperature control system of claim 1, further comprising a heat source disposed in the air conditioning circuit.

6. The temperature control system of claim 5, wherein the heat source is an electric heat source.

7. The temperature control system of claim 1, further comprising a second valve device configured to fluidly connect the first and second subcircuits with one another in a first switching mode and to fluidly disconnect the first and second subcircuits from one another in a second switching mode.

8. A temperature control system for a hybrid powertrain, comprising:

a first coolant circuit for controlling a temperature of a first drive device of the hybrid powertrain;

a second coolant circuit for controlling a temperature of a second drive device of the hybrid powertrain, said second coolant circuit having a first subcircuit, connected in a heat-transmitting manner to a drive unit of the second drive device, and a second subcircuit, connected at least temporarily in a heat-transmitting manner to an energy store for the drive unit of the second drive device, said first and second subcircuits being operable separately from one another; and a coolant duct connected to the first drive device in a heat-transmitting manner, said coolant duct being fluidly connected in a first operating mode with the first coolant circuit in the absence of a fluid communication with the second coolant circuit, and fluidly connected in a second operating mode with the second coolant circuit in the absence of a fluid communication with the first coolant circuit, wherein the second coolant circuit includes a bypass line to bypass the energy store.

9. A temperature control system for a hybrid powertrain, comprising:

a first coolant circuit for controlling a temperature of a first drive device of the hybrid powertrain;

a second coolant circuit for controlling a temperature of a second drive device of the hybrid powertrain, said second coolant circuit having a first subcircuit, connected in a heat-transmitting manner to a drive unit of the second drive device, and a second subcircuit, connected at least temporarily in a heat-transmitting manner to an energy store for the drive unit of the second drive device, said first and second subcircuits being operable separately from one another;

a coolant duct connected to the first drive device in a heat-transmitting manner, said coolant duct being fluidly connected in a first operating mode with the first coolant circuit in the absence of a fluid communication with the second coolant circuit, and fluidly connected in a second operating mode with the second coolant circuit in the absence of a fluid communication with the first coolant circuit, and a heat exchanger disposed in the second coolant circuit and connected to a refrigerant circuit.

10. The temperature control system of claim 9, wherein the heat exchanger is disposed in the second subcircuit of the second coolant circuit.

11. A hybrid powertrain, comprising:

a first drive device;

a second drive device; and a temperature control system which includes a first coolant circuit for controlling a temperature of the first drive device, a second coolant circuit for controlling a temperature of the second drive device of the hybrid powertrain, said second coolant circuit having a first subcircuit, connected in a heat-transmitting manner to a drive unit of the second drive device, and a second subcircuit, connected at least temporarily in a heat-transmitting manner to an energy store for the drive unit of the second drive device, said first and second subcircuits being operable separately from one another, and a coolant duct connected to the first drive device in a heat-transmitting manner, said coolant duct being fluidly connected in a first operating mode with the first coolant circuit in the absence of a fluid communication with the second coolant circuit, and fluidly connected in a second operating mode with the second coolant circuit in the absence of a fluid communication with the first coolant circuit, wherein the first coolant circuit includes an air conditioning circuit and a cooling circuit configured for operation independently from the air conditioning circuit, said coolant duct being part of the cooling circuit at least temporarily.

12. A method of operating a temperature control system, comprising:

controlling a temperature of a first drive device of the hybrid powertrain via a first coolant circuit;

controlling a temperature of a second drive device of the hybrid powertrain via a second coolant circuit by connecting a first subcircuit of the second coolant circuit in a heat-transmitting manner to a drive unit of the second drive device, and by connecting a second subcircuit of the second coolant circuit, at least temporarily, in a heat-transmitting manner to an energy store for the drive unit of the second drive device, with the first and second subcircuits being operable separately from one another;

connecting a coolant duct to the first drive device in a heat-transmitting manner such that the coolant duct is fluidly connected in a first operating mode with the first coolant circuit in the absence of a fluid communication with the second coolant circuit, and fluidly connected in a second operating mode with the second coolant circuit in the absence of a fluid communication with the first coolant circuit, and operating a cooling circuit of the first coolant circuit independently from an air conditioning circuit of the first coolant circuit, with the coolant duct being part of the cooling circuit at least temporarily.

13. A method of operating a temperature control system, comprising:

controlling a temperature of a first drive device of the hybrid powertrain via a first coolant circuit;

controlling a temperature of a second drive device of the hybrid powertrain via a second coolant circuit by connecting a first subcircuit of the second coolant circuit in a heat-transmitting manner to a drive unit of the second drive device, and by connecting a second subcircuit of the second coolant circuit, at least temporarily, in a heat-transmitting manner to an energy store for the drive unit of the second drive device, with the first and second subcircuits being operable separately from one another;

connecting a coolant duct to the first drive device in a heat-transmitting manner such that the coolant duct is fluidly connected in a first operating mode with the first coolant circuit in the absence of a fluid communication with the second coolant circuit, and fluidly connected in a second operating mode with the second coolant circuit in the absence of a fluid communication with the first coolant circuit; and providing a bypass line in the second coolant circuit to bypass the energy store.

14. The method of claim 13, further comprising operably connecting a first valve device to the second coolant circuit such as to connect the second coolant circuit in a first switching mode with a coolant cooler and to connect the second coolant circuit in a second switching mode to the coolant duct.

15. The method of claim 13, further comprising disposing a heat source in the first coolant circuit.

16. The method of claim 13, further comprising fluidly connecting the first and second subcircuits with one another in a first switching mode of a second valve device, and fluidly disconnecting the first and second subcircuits from one another in a second switching mode of the second valve device.

17. A method of operating a temperature control system, comprising:

controlling a temperature of a first drive device of the hybrid powertrain via a first coolant circuit;

controlling a temperature of a second drive device of the hybrid powertrain via a second coolant circuit by connecting a first subcircuit of the second coolant circuit in a heat-transmitting manner to a drive unit of the second drive device, and by connecting a second subcircuit of the second coolant circuit, at least temporarily, in a heat-transmitting manner to an energy store for the drive unit of the second drive device, with the first and second subcircuits being operable separately from one another;

connecting a coolant duct to the first drive device in a heat-transmitting manner such that the coolant duct is fluidly connected in a first operating mode with the first coolant circuit in the absence of a fluid communication with the second coolant circuit, and fluidly connected in a second operating mode with the second coolant circuit in the absence of a fluid communication with the first coolant circuit; and disposing a heat exchanger in the second coolant circuit, and connecting the heat exchanger to a refrigerant circuit.

18. The method of claim 17, wherein the heat exchanger is disposed in the second subcircuit of the second coolant circuit.

* * * * *